United States Patent [19]

Humphrey

[11] Patent Number: 4,986,561

[45] Date of Patent: Jan. 22, 1991

[54] METHOD AND APPARATUS FOR SPEED AND MANEUVERABILITY CONTROL FOR DOWNHILL SKIING

[75] Inventor: John M. Humphrey, Monte Sereno, Calif.

[73] Assignee: Humphrey Engineering, Inc., Monte Sereno, Calif.

[21] Appl. No.: 544,051

[22] Filed: Jun. 27, 1990

Related U.S. Application Data

[63] Continuation of Ser. No. 126,211, Nov. 27, 1987, abandoned.

[51] Int. Cl.[5] ..... A63C 5/06

[52] U.S. Cl. ..... 280/605; 280/606; 280/809

[58] Field of Search ..... 280/601, 604, 605, 606, 280/809, 816, 817, 900, 28.11; 188/5, 8

[56] References Cited

U.S. PATENT DOCUMENTS

| | | | |
|---|---|---|---|
| 3,295,859 | 1/1967 | Perry | 280/601 |
| 4,911,461 | 3/1990 | Humphrey | 280/605 |

FOREIGN PATENT DOCUMENTS

| | | | |
|---|---|---|---|
| 14420 | 8/1903 | Austria | 280/604 |
| 650475 | 9/1937 | Fed. Rep. of Germany | 280/604 |
| 3543829 | 6/1987 | Fed. Rep. of Germany | 280/605 |
| 736916 | 12/1932 | France | 280/605 |
| 816949 | 8/1937 | France | 280/605 |
| 433183 | 4/1948 | Italy | 280/604 |
| 187456 | 2/1937 | Switzerland | 280/605 |

*Primary Examiner*—Richard A. Bertsch
*Assistant Examiner*—Tamara L. Finlay
*Attorney, Agent, or Firm*—John J. Leavitt; Douglas R. Hanscom

[57] ABSTRACT

Presented is a method and apparatus that permits a skier to control the speed at which he descends a ski slope. In terms of structure, the invention includes a pair of probes mounted on each ski that protrude below the running surface of the ski and thereby drag in the snow. The probes may be controlled as to the depth of penetration of the snow either before the skier starts his run, or during his descent. Having deployed the probes, added manueverability control is achieved merely by conventional body movements which affect the depth to which the probes penetrate the snow.

13 Claims, 5 Drawing Sheets

METHOD AND APPARATUS FOR SPEED AND MANEUVERABILITY CONTROL FOR DOWNHILL SKIING

This application is a continuation of application Ser. No. 07/126,211, filed Nov. 27, 1987 , abandoned.

BACKGROUND OF THE INVENTION

1. Field of the Invention.

This invention relates to skis and snow skiing, and more particularly to a method and apparatus that enables a skier to achieve enhanced maneuverability and improved speed control in the activity of downhill snow skiing.

2. Description of the Prior Art.

A review of the prior art has convinced me that the subject of the instant invention is the only method and apparatus which:

(a) provides a downhill skier with enhanced control over both axial drag and lateral maneuverability; and (b) provides both of the above enhancements by selective use of the skier's natural body movements.

A search of the prior art has revealed the existence of the following U.S. Pat. Nos.

| | | |
|---|---|---|
| 3,980,322 | 3,918,730 | 3,909,024 |
| 3,195,911 | 3,048,418 | 4,152,007 |
| 4,103,916 | 4,062,561 | 4,227,708 |
| 3,873,108 | 4,312,517 | 4,227,714 |

At the outset, it is well to understand that the invention forming the subject matter of this specification does not concern the problem of stopping a loose ski that has become separated from a skier. Rather, this invention focuses on the problem of imposing additional controlling forces on the skis in a downhill skiing environment in such a way that the skier will feel more in control at the speed at which he is descending.

Referring to the patents listed above, all of the patents except U.S. Pat. Nos. 4,152,007 and 4,227,708 relate to the situation where a ski has been separated from a skier and is loose on the ski slope and apt to cause some damage or injury to skiers unless stopped. These "loose ski brake" devices do not operate during active skiing, and are clearly unrelated to the structure and function of the invention described herein.

U.S. Pat. No. 4,152,007 provides snow plows at the rear ends of the skis that are activated by hydraulic pressure controlled through the grips on the ski poles. Obviously, there must be some connection between the grips on the ski poles and the snow plows and this in itself is a disadvantage in that the skier is prevented from utilizing the ski poles as freely as he might for the purpose for which they are intended. This device provides active drag control, which is the only function it shares with my invention described herein. The characteristics of this device are in sharp contrast with the enhanced maneuverability provided by my invention. Because the plows in this device are at the rear ends of the skis and therefore far behind the skier's center of gravity, they actually tend to prevent the skier from turning while they are engaged. The hydraulic actuation is also significantly different than the normal skiing motions that are effective to control the maneuverability characteristics of my invention. Therefore, this device is clearly functionally and structurally different from my method and apparatus.

U.S. Pat. No. 4,227,708 relates to a ski brake that comprises a plate fixed on the upper surface of the ski. The plate is provided with a notch into which the lower end of the ski pole may be inserted to produce drag against the snow. While the primary purpose of this device is to provide traction in cross-country skiing, it purports to provide active braking for a cross-country skier moving downhill. Active braking is also one of the at least three important functions of my apparatus. However, this device does not provide either the enhanced maneuverability or control by natural body motions provided by my apparatus. Maneuverability is an essential difference between downhill skiing and cross-country skiing. The bindings of cross-country skis naturally limit maneuverability. Since this device applies drag only on the outside of the skis, downhill braking would tend to spread the tips of the skis, making the skis even more difficult to maneuver. Use of the ski poles as braking levers violates the natural motions of downhill skiing which requires upper body movement and free use of the poles. Therefore, this device, while obviously structurally different from my apparatus in all its embodiments, is also clearly incapable of performing two of at least three major functions performed by my apparatus.

For those that are experienced skiers, it will be obvious that skiing on a steep slope requires considerably more physical effort and skill than skiing on a gentle slope. Turning maneuvers to reduce speed require the skier to generate a force in opposition to the force tending to propel the skier downhill. This force, multiplied by the skier's velocity, equates with the power the skier must exert to maintain speed control on the slope. Steeper slopes require both a greater maximum force and a greater average power which together require greater strength and endurance from the skier. Expert skiers have several advantages over less advanced skiers. First, since they have a higher ability threshold, a greater fraction of the potential energy during the run is consumed in aerodynamic and ski drag. Second, since they are more skillful, they are able to make turns with less muscle strain. Although expert skiers still must exert the same force as less experienced skiers, they apply it more effectively in reducing speed.

As stated above, the primary purpose of my method and apparatus is to enhance the safe enjoyment of downhill skiing by significantly reducing the level of skill and physical strength required to participate in the sport.

The method and apparatus of my invention enables a skier to safely handle terrain that would otherwise be beyond his ability. It is believed that wide spread use of my method and apparatus will increase the number of individuals participating in downhill skiing and will reduce the number of injuries sustained by such participants when they are inadvertently caught in situations beyond their ability.

The sport of downhill skiing involves executing trained physical body motions that change the skier's spacial orientation and weight distribution as the skis slide across the snow. The maneuvers that result from such body motions enable the skier to control his direction and most importantly his speed.

In the sport of downhill skiing, the skier converts potential energy into mechanical work and ultimately into heat. By the conservation of energy, the rate of change of potential energy equals the rate of change of kinetic energy plus the rate of mechanical work performed by the skier. This mechanical work rate (or power) is the skier's velocity times the snow friction and air drag. Steeper slopes require a greater friction plus drag force to hold a given speed than more gentle slopes.

A skier's strength and skiing ability determine the steepness of the slope that he can comfortably and safely handle. Skiing skill determines how efficiently a skier can convert muscle force into useful drag. The snow-plow is a perfect example of an inefficient skiing maneuver. In the snow-plow the skier pushes outward on his skis and thereby creates an axial force equal to his lateral force times the sine of the angle of his skis. Since the "V" half angle of his skis is typically only about 15 degrees or less only one quarter of his lateral force is converted into useful drag. This situation is compounded by the awkward nature of the snow-plow maneuver.

Proficient skiers have several advantages over beginning skiers. First, they can ski at a higher average speed letting ski friction and aerodynamic drag (which are relatively non-fatiguing) generate mechanical work at a faster rate. Second, they can convert muscle force more efficiently into useful drag. A good parallel skier can seemingly effortlessly make small turns and efficiently use his leg muscles to react the drag force needed to keep his speed under control. Third, the proficient skier is often in better physical condition and has greater strength and endurance than beginning skiers.

Enjoyable skiing is a process of speed control. If a skier is not in excellent condition, and he is unable to efficiently convert his muscle forces into drag, he will either be limited to gentle and uninteresting terrain or, more typically, he will ski on terrain beyond his ability and risk injury to himself and others. Unfortunately, our modern society neither encourages physical fitness nor provides extended leisure time to learn new activities. This results in millions of people who would like to enjoy downhill skiing, but have not found the time to become advanced intermediate skiers where they can really begin to enjoy the sport. Accordingly, a method and apparatus such as described herein is needed to reduce the level of skill required to enjoy downhill skiing by permitting skiers to more efficiently convert muscle force into speed control and maneuverability while retaining the natural motions of skiing.

Another element enters into the method of speed control and has been alluded to somewhat above. That is the fact that conventionally speed control is effected by manipulating turns on the slope to introduce a force that is in opposition to the downhill acceleration force that is imposed by gravity and the steepness of the slope. Accordingly, if some method or means could be devised by which turns could be effected without the imposition of discomfort on the skier or the utilization of excessive muscle force, then the skier would be more likely to attempt a run on a steep slope that he would not otherwise feel comfortable with.

Accordingly, one of the important objects of the present invention is to provide a method and means by which a skier may selectively control maneuverability and therefore speed on a downhill ski slope.

The invention achieves selective maneuverability and speed control by adding fluid dynamic control surfaces on downhill skis to enhance both axial drag and maneuverability using a skier's natural motions. These additional control surfaces generate forces that augment the edge control forces on the skis. The control surfaces of my invention, referred to herein as "probes", are analogous to the spoiler/flap system on modern jet airplanes in terms of vehicle drag and stability characteristics. Since snow only produces loads below the running surface of the ski, another object of my invention is the provision of a method and apparatus for differentially varying probe depth on the inside and outside edges of the skis.

The following discussion illustrates how the probes of my invention enhance the speed and maneuverability control characteristics of snow skis. The detailed description of the structures (including the probes) that provide these characteristics is presented later in this disclosure. That description also presents features of the structures which facilitate the operation of the invention but which do not directly affect the speed and maneuverability control aspects discussed below.

Accordingly, a still further object of the invention is the provision of apparatus which in the engaged or operative position, extends two probes on each ski a precise distance below the running surface of the ski into the snow. These probes act as additional control surfaces that augment the forces acting on the other ski surfaces during downhill skiing.

A still further object of the invention is the provision of apparatus in conjunction with snow skis which when engaged and operative, has the effect of making a slope appear to be more gentle, and which includes probes which project below the running surface of the ski to provide additional drag which reduces the skier's acceleration and terminal velocity.

Still another object of the invention is the provision of apparatus for snow skis, including projecting probes, which can be adjusted either before or during a run so as to adjust the basic drag coefficient by adjusting the depth of the probe's extension below the running surface of the skis.

Although these steady drag effects are important, the primary additive drag effects occur as a result of skier controlled probe depth variation during the ski run. Tests have shown that the drag imposed on a ski by a probe projecting into the snow is a strong function of probe depth. Accordingly, a still further object of the invention is the provision of an apparatus including pairs of probes attached to the skis in such a manner that rotating the ski about the longitudinal axis increases the penetration depth on one probe and decreases the penetration depth of the other probe on that ski. This differential probe depth causes a significant increase in the total drag, because of the large increase in drag on the deeper probe. This has two primary applications in downhill skiing speed control as will now be explained. The snow-plow maneuver becomes far more effective and less strenuous to execute. Simply rotating the knees together (with the skis pointed straight) produces a large drag increase due to the greater penetration of the inside probes. The differential torque created by the drag on the inside probes automatically draws the ski tips together, adding the normal snow-plow edge drag, but without the muscle strain normally required. Rotating the knees back to vertical returns the skis to normal parallel position and equalizes the forces on the skis, cancelling the differential torque.

Parallel turns are more effective in achieving speed reduction when the skis are equipped with my probe system. The edge drag is supplemented by probe drag.

Effective speed control can be accomplished with very little edge drag which is quite helpful under poor snow conditions.

Turning ability, which is a major factor in maneuverability, is significantly enhanced because the probes enable turning by leaning. For example, leaning to the right increases the penetration depth and drag on the right probes on both skis and decreases the depth and drag on the left probes. This both increases the total drag and creates a rotational moment that turns the skis to the right. Similarly, leaning to the left turns the skier to the left. As discussed below, the skier can further enhance turning ability by leaning slightly backward as he leans to the left or right.

The method and apparatus of my invention provides "trim" adjustment to reduce muscle strain associated with holding the skis together. Most people walk with their feet slightly spread apart and their muscles are adjusted to that position. Therefore, parallel skiing requires a constant muscle strain to hold the tips of the skis together. With my method and apparatus, a skier can alleviate this condition by adjusting the depth of penetration of the inside probes to be slightly greater than the depth of penetration of the outside probes. This creates a toe-in moment on the skis which keeps the tips together without continuous muscle strain by the skier.

The following discussion relates to the features of my invention which, taken individually or in combination, account for the speed control and maneuverability enhancement characteristics discussed above.

1. Precise depth control. — Since drag is a strong function of depth, the probes of my invention are designed to provide precise setting and control of their extension past the running surface of the skis.

2. Probe center of pressure location. — Probe location near the center of pressure of the skis, which is also near the skier's center of gravity when sking downhill is necessary to provide the desired neutral lateral stability characteristics. Locating the probes aft of the skier's center of gravity (i.e., a positive stability margin as in the classic loose ski brake) would make turning more difficult because the probes would produce a restoring moment tending to keep the skis pointed in the direction of travel. Locating the probes forward of the center of gravity (i.e. negative stability margin) would make the skis rotationally unstable.

The foregoing will be better understood if it is considered that many skis are visually marked with a center of gravity indicia located about midway between the toe piece and the heel piece. However, this location of the indicia marks the center of gravity of the ski and skier when the skier is standing erect or vertically, or "at rest" on the skis. In a downhill run, the skier leans forward, his body mass also moves forward in relation to the skis, and so does the center of gravity, which is now located forwardly from the indicia and at the intersection of the vertical projection of the skier's body mass and the plane of the skis. This forward position of the center of gravity of the skier is correlated to the probe location associated with the center of pressure of the skis, which I have found to be closely associated with the toe piece.

Accordingly, my invention locates the probes about the middle of the toe piece of the ski boot attachment means which is the natural location of the center of pressure and the skier's center of gravity when the skier is leaning slightly forward in a downhill run. Obviously, the exact optimum location will vary somewhat depending on the skier and the terrain. The skier can control his center of gravity location in relation to probe location associated with the center of pressure and thereby control the stability characteristics of his skis. By leaning forward (and moving his center of gravity forward of the probes) the probes act to keep the skis pointed in the direction of travel and stabilize any lateral oscillations. By leaning backward during turning, the skier can enhance turning by moving the center of gravity slightly aft of the probes and making the skis deliberately unstable. The skier would obviously do this after he had started a turn and had both his skis clearly rotated in one direction.

3. Two pin characteristics.—Many of the desirable characteristics of my method and apparatus require two pins (one on each side of the ski). A single pin configuration as illustrated in FIGS. 14 and 15, locates the pin under the toe piece and provides a steady drag and facilitates turning by the center of gravity shift mechanism discussed above. However, the two pin design adds the ability to increase drag by leaning as in parallel turns or by rotating the knees together, as in a snow-plow maneuver. The turning by leaning feature requires a two pin arrangement; the turning by aft center of gravity shift only starts to work after the skis have rotated relative to the direction of travel.

4. Probe lift-drag characteristics.—The shape and orientation of the probes are important in establishing the operating characteristics of the method and apparatus of my invention. While I have illustrated and described herein probes which constitute cylindrical rods, it is apparent that other configurations may be utilized within the spirit and scope of the invention. As indicated above, the preferred probe configurations shown in the embodiment illustrated are all cylindrical. This axisymmetric shape is an advantage because it provides the facility to provide for the threaded depth adjustments used on several of the embodiments. However, the probes are not restricted to axisymmetric shapes. Shapes such as ellipsis, wedges, airfoils or other profiles offer potential advantages under certain conditions and are intended to be covered within the scope of this invention.

With respect to orientation of the pins, vertical pins produce no lift, and this is an advantage for the beginning skier. Rotating the skis to produce drag does not require any force to overcome lift. This is an advantage for the snow-plow maneuver, but less important for the turning by leaning maneuver. Vertical pins provide higher drag (and slower speeds) under poor snow conditions.

As illustrated in the drawings, and described hereinafter, a slightly backwards probe cant is the preferred orientation for the probes. The cant reduces the drag coefficient parallel to the skis without significantly changing the drag coefficient perpendicular to the skis. These characteristics mean less steady state drag with the same turning ability due to the high drag perpendicular to the skis. The lift produced on icy snow reduces the penetration depth and reduces the drag parallel to the skis without affecting turning ability. Again, the optimum cant angle depends on the skier, the terrain and snow conditions. Although the preferred embodiment incorporates canted probes, it will of course be obvious that the invention encompasses a full range of probe angles.

It appears that an unexpected benefit is derived by the use of my method and apparatus that relates to the condition of a ski slope. Conventionally, ski slopes are used during daylight hours and are "groomed" during the night time to prepare them for another full day of skiing the following day. I have found that because the control forces applied to the skis by the probes are relatively small and because packed snow is a viscous fluid, probe depth of only ¼ to ½ inch appear to be adequate for most conditions. I have found that penetration of the snow by the probes creates a hardly perceptible groove in the snow. Tests have shown that the almost imperceptible grooves left by the probes are almost invisible and quickly disappear in normal pack-powder snow. I have also found that these tiny grooves appear to help groom the slopes under high packed or moderately icy snow conditions. When the snow becomes icy, edge control becomes difficult because the edge loading is insufficient to cause penetration of the snow by the ski edge. This is also true for the probes under severely icy conditions. However, under hard packed or moderately icy conditions, the probes easily penetrate the snow surface. This feature gives the skiers significantly improved control under these conditions while the probes help break up the hard ice surface. Accordingly, if enough skiers use the probe system of my invention, it is easy to see that their combined actions would help prevent hard or icy layers from forming on the slopes.

The invention possesses other objects and features of advantage, some of which with the foregoing will be apparent from the following description and the drawings. However, it is to be understood that the invention is not limited to the embodiments illustrated and described, since it may be embodied in various forms within the scope of the appended claims.

SUMMARY OF THE INVENTION

In terms of broad inclusion, there is presented as an auxiliary ski control attachment to a ski, control surfaces which the skier may manipulate to control the amount and direction of application of auxiliary control forces imposed on the skis during a downhill ski run. In one aspect of the invention, means are provided attached to the skis in the area of the bindings or ski boot attachment means which are manipulable to project a probe below the running surface of the ski to thus penetrate the snow and cause a retarding force to occur. In this aspect of the invention, the projecting probe may be pre-set prior to the downhill run so that the control surface is always in operation during the downhill run, or, in another aspect, the projecting probe may be adjusted during the downhill run to compensate for variations in the steepness of the slope. In still another aspect of the invention, means are provided in association with the bindings, being cognizant of the optimum center of gravity of the skis and skier, for projecting the bottom end of the ski pole through an appropriate aperture formed in the ski so as to deploy the control surface. In still another aspect of the invention, there is provided a drag means constituting a projecting probe that projects below the running surface of the ski and which is mounted in such a way that it is instantly retractable if the projecting probe strikes an immovable object such as a buried tree trunk or rock. In still a different embodiment, means are provided in the nature of a projecting probe that projects below the running surface of the ski and which may be adjusted in its height to control the amount of drag thus imposed on the skis.

DESCRIPTION OF THE PREFERRED EMBODIMENT

The method and means described and illustrated herein enhances the safe enjoyment of downhill skiing by significantly reducing the level of skill and physical strength required to participate in the sport. Thus, it is expected that this invention will augment the numbers of individuals particpating in the sport, and will serve to diminish the number of injuries sustained by such participants resulting from such participants being inadvertently caught in a dangerous situation beyond the threshold of their ability. The method and means described and illustrated herein places at the disposal of the skier means for closely controlling the amount of drag required to be imposed on the skis to control acceleration and/or deceleration.

Referring to FIGS. 1, 2, 3 and 4, there is there shown a drag probe mechanism that is adjustable by the skier between predetermined limits of probe depth, ranging from zero probe depth at which no auxiliary drag is imposed on the skis, to a maximum probe depth useful for the novice skier just learning to traverse the steeper slopes. As there shown, the ski 13 is provided with a running surface 14 and a top surface 16 on which is fixedly supported in a manner which will hereinafter be explained the drag probe mechanism designated generally by the numeral 17.

Figure 1:
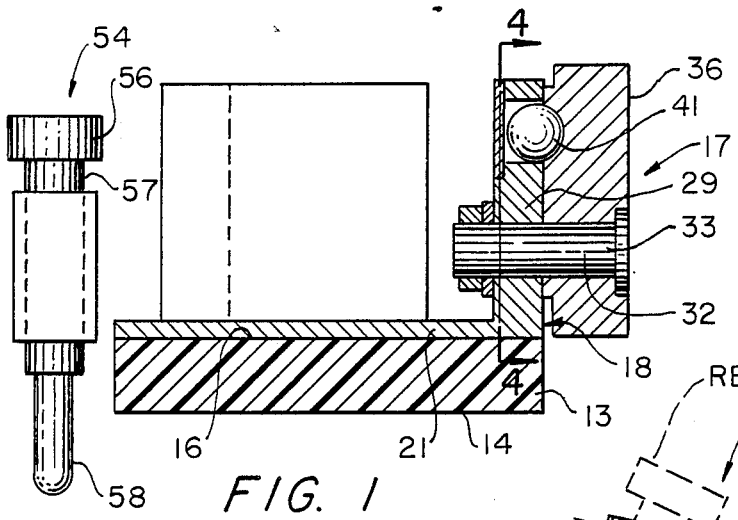
FIG. 1 is a vertical cross-sectional view illustrating the preferred embodiment of my invention, the section taken in the plane indicated by the line 1—1 of FIG. 3
Figure 3:
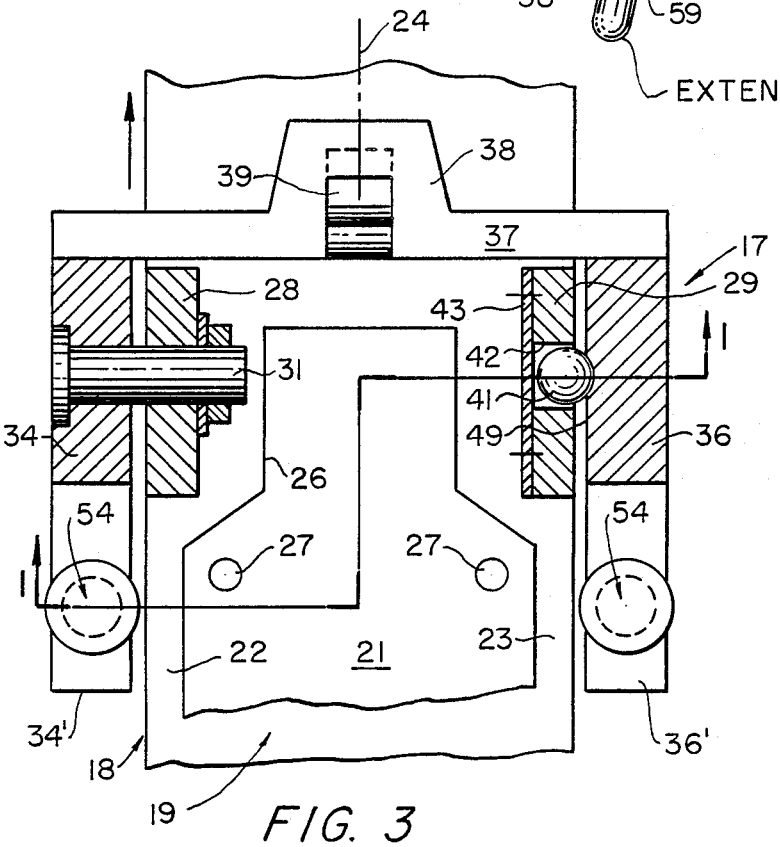
FIG. 3 is a plan view of the preferred embodiment of the invention illustrated in FIGS. 1 and 2.
Figure 4:
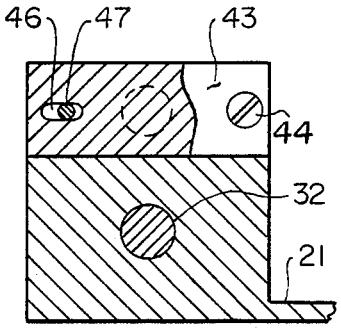
FIG. 4 is a fragmentary vertical cross-sectional view illustrating the resilient detent plate. The view is taken in the plane indicated by the line 4—4 in FIG. 1.

As illustrated in FIGS. 1 and 3, the drag probe mechanism includes a base member 18, conveniently fabricated from an injection molded plastic or an appropriate metal, to provide a recessed center section designated generally by the numeral 19, and formed by a relatively thin plate-like section 21 having raised marginal portions 22 and 23 on opposite sides of a plane vertical to the top surface 16 of the ski and generally coincident with the longitudinal axis 24 of the ski.

As illustrated in FIG. 3, the raised marginal portions 22 and 23 are provided with inner peripheral wall sections 26 that conform generally to the exterior configuration of the toe piece which forms a part of the ski boot attachment means that is conventionally fixedly secured to the top surface of the ski to retain the skier's boot clamped to the ski. In the interest of clarity, the toe piece is not illustrated. It should be understood however that the toe piece is fastened to the top surface of the ski by a pair of screws that penetrate the screw holes 27 formed in the member 21, and that the flat thin plate-like member 21 underlies the toe piece, and is securely clamped to the top surface 16 of the ski by the same screws that penetrate the screw holes 27 and which retain the toe piece in place.

The base member 18, at its forward end is provided with upwardly extending bearing blocks 28 and 29, these being preferably integral with the base member 18, but possibly being separate components that are fixed to the base member by any appropriate means that will insure their retention on the base member. The bearing blocks 28 and 29 form journals for the pivot pins 31 and 32, the shank portions 33 of which provide bearing surfaces for the laterally opposed arms 34 and 36 connected at their forward ends by a front cross member 37 provided with a centrally disposed thickened portion 38 as viewed in FIG. 3 which is provided with a recess 39 into which the skier may insert the lower end of a ski pole in order to effect pivotal adjustment of the arms 34 and 36 in relation to a ball 41 forming a resilient detent mechanism and including a bore 42 in the bearing block 29, the back side of the bearing block 29 having fastened thereto a resilient plate 43 fixed to the back side of the block 29 by a screw 44 (FIG. 4) and on the opposite side of the ball 41, adjacent the opposite end of the plate 43, provided with a slot 46 adapted to receive a guide pin 47.

Thus, a skier may insert the end of a ski pole into the yoke recess 39 and by appropriate forward or backward movement, impose a turning moment on the arms 34 and 36 about the axially aligned pivot pins 31 and 32, concomitantly causing the detent ball 41 to rest in a selected one of a series of shallow depressions formed on the inside surface of the arm 36. Thus, as viewed in FIG. 2, a forwardly directed force exerted on a ski pole engaged in the yoke recess 39 and aligned with the central axis 48 of that recess, will cause the arm 36 to pivot clockwise about the pivot pin 32 while the ball 41 rides up on the inner surface 49 of the arm 36 between the recess 51 in which it is located in FIG. 2, prior to the ball dropping into the next successive recess 52. Continued pressure in the direction of the arrow causes the ball to be displaced from the recess 52, rise up on the surface 49 again and then fall into the third recess 53.

Figure 2:
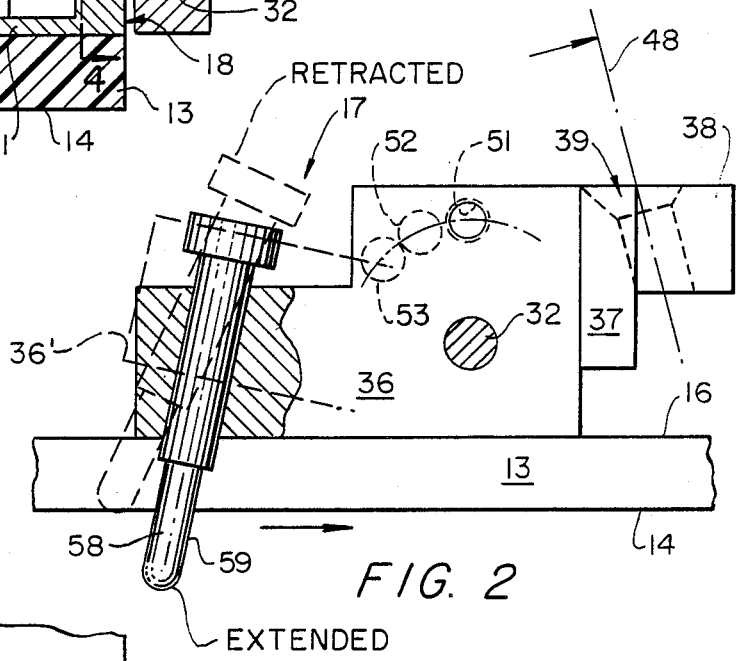
FIG. 2 is a side elevational view of the preferred embodiment of the invention illustrated in FIG. 1.

The purpose of being able to pivot the yoke arms 34 and 36 as discussed above is to enable the height adjustment of the rearwardly projecting arm portions 34' and 36', so as to position the drag probe designated generally by the numeral 54, one each of which is threadably mounted in the rearwardly extending portions 34' and 36' as illustrated in FIGS. 1, 2, and 3. Preferably, the drag probe 54 is provided with a head portion 56, a shank portion 57 threadably engaged in the rearwardly projecting arm portions 34 and 36, and a cylindrical control or drag portion 58 adapted to project below the lower running surface 14 of the ski as illustrated in FIG. 2, or to be elevated into the disengaged position illustrated in broken lines in FIG. 2 when force is applied in the direction of the arrow by proper manipulation of a ski pole engaged in the recess 39.

It will of course be understood that while I have illustrated the probe 54, and particularly the drag portion 58 thereof, in a slightly rearwardly inclined or canted attitude, for reasons which will be hereinafter explained, it is possible that this probe be positioned so that it projects perpendicularly to the lower surface 14 of the ski, and in an appropriate circumstance, the probes 54 could even be canted forwardly, i.e., to more deeply penetrate the snow below the ski surface 14.

Referring to the detent arrangement 41–43, it should be noted that as the probe adjustment arms 34 and 36 are pivoted upwardly and the periphery of the detent ball 41 climbs up onto the inside surface 49 of the arm 36, lateral pressure is applied against the plate 43, causing it to flex laterally away from the surface of the block 29 to which it is fastened. The inherent resilience of the plate 43 causes the detent ball 41 to snap into the next successive recess formed in the arm 36 when it becomes properly aligned with the detent ball 41. Obviously, there are many different equivalent methods and means for providing a detent mechanism such as this, and it is intended that this invention not be limited by the specific detent mechanism illustrated.

As indicated above, it is preferable that the probe 54 have a rearwardly directed cant as illustrated in FIG. 2, so that as the ski moves forwardly over the snow in the direction indicated by the arrow, the forwardly facing surfaces 59 of the probe portion 58 in contact with the snow, being inclined to the direction of movement, develops a component of lift which is beneficial in the operation of the device. Referring to FIG. 3, it will be seen that the laterally spaced pair of probes 54 are positioned in relation to the toe piece such that it places the probes near the skier's center of gravity. This is desirable to provide a desired neutral lateral stability characteristic. Locating the probes aft of the skier's center of gravity (i.e., a positive stability margin as in the classic loose ski brake) would make turning more difficult because the probes would produce a restoring moment tending to keep the skis pointed in the direction of travel. Locating the probes forward of the center of gravity (i.e., negative stability margin) would make the skis rotationally unstable. As indicated, the probes in this embodiment are located or positioned about the middle of the toe piece which is the natural location of the skier's center of gravity when leaning slightly forward. The skier can control his center of gravity location by appropriate body motion and thereby control the stability characteristics of his skis. By leaning forward during a straight skiing run, the skier moves his center of gravity forward of the probes, allowing the probe drag to help keep the skis pointed straight and damping lateral oscillations. By leaning backward during turning, the skier can enhance turning by moving the center of gravity slightly aft of the probes and making the skis deliberately unstable. He would do this after he had started the turn and had both his skis clearly rotated in a common direction.

Figure 14:
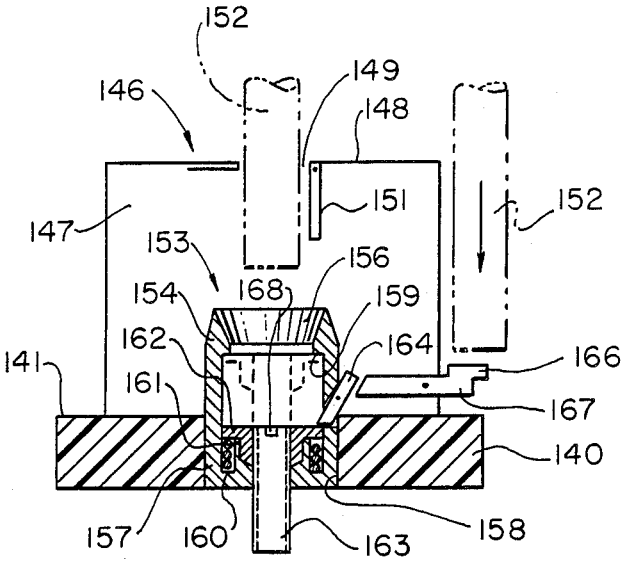
FIG. 14 is a fragmentary front elevational view of a ski equipped with a single centrally mounted probe as distinguished from a pair of side-mounted probes.
Figure 15:
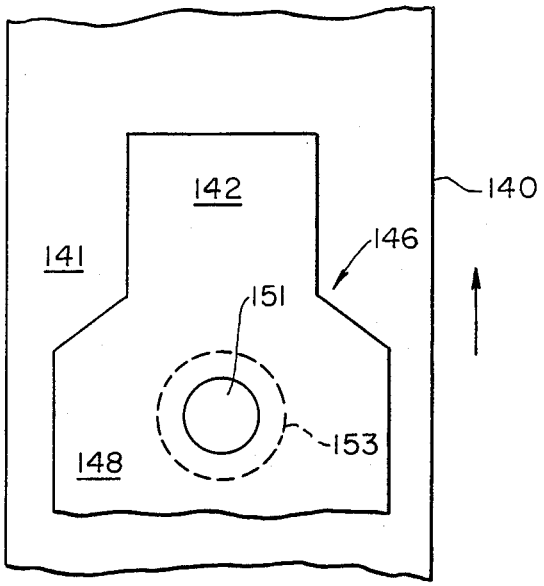
FIG. 15 is a fragmentary top plan view of the embodiment illustrated in FIG. 14.

It is because of these added characteristics which may be controlled by the skier that I prefer a speed control device utilizing two laterally spaced drag probes, positioned on opposite sides of each ski near the middle of the toe piece and the natural location of the skier's center of gravity. Obviously, a single pin under the toe piece, as illustrated in FIGS. 14 and 15, could provide a steady drag increase and facilitate turning by the center of gravity shift mechanism discussed above, but the two pin design illustrated in FIG. 3 adds the ability to increase drag by leaning as in parallel turns or by rotating the knees together (as in a snow-plow manuver). The turning by leaning feature requires a two pin arrangement; the turning by aft center of gravity shift only starts to work after the skis have rotated relative to the direction of travel.

The shape and orientation of the probes are important factors in establishing the operating characteristics of the device. The basic design illustrated in FIGS. 1 through 3 features rearwardly canted cylindrical pins. As stated previously, vertical pins produce no lift, which is an advantage for the beginning skier. Rotating the skis about their longitudinal axis to produce drag on one side of the ski or the other does not require any force to overcome the lift component produced by a canted probe. This is particularly important for the snow-plow maneuver, and less important for the turning by leaning maneuver. Additionally, vertical pins provide higher drag, and therefore slower speeds, under poor snow conditions.

A slightly backwardly canted probe is believed to be more appropriate for advanced skiers. The cant reduces the drag coefficient parallel to the skis without significantly changing the drag coefficient perpendicular to the skis. These characteristics would mean less steady state drag with the same turning ability due to the high drag perpendicular to the skis. The lift produced on icy snow would reduce the penetration depth and reduce the drag parallel to the skis without affecting turning ability. Because of the reduced drag parallel to the skis, the acceleration rate of the skis is increased, resulting in reaching the velocity-ability level of the skier in a shorter time frame, which is more apt to be handled expertly by the advanced skier.

Referring to FIGS. 2 and 3, and assuming that both probes 54 are adjusted to penetrate the snow to the same depth on a straight and level run down a slope, it will be seen that rotating the knees toward each other or together, in the conventional snow-plow maneuver, causes the inboard probes 54 on each ski to dig deeper into the snow, and concomitantly lifts the outboard probes out of the snow, thus diminishing the drag on the outboard probes. This results in a turning moment being applied to the skis, thus automatically rotating the ski tips together to execute the "snow-plow" maneuver. The existence of the drag probes clearly facilitates this maneuver.

In the "turning by leaning" maneuver, the skier leans to the left or leans to the right, and the edges of the skis facing in the direction in which the skier leans will automatically bite into the snow to a deeper degree than the opposite edges of the skis, again causing the probes on the sides of the skis corresponding to the direction of leaning by the skier to generate a moment of rotation about the center of gravity of the skier. This causes the skis to turn in the direction in which the skier has leaned. Again, the presence of the drag probes clearly facilitates this maneuver.

As stated above, shifting of the center of gravity by the skier rearwardly behind the normal center of gravity, increases the instability of the skis, but enhances the ability to negotiate parallel turns once the turn has been initiated. Obviously, this maneuver is best performed by an advanced skier.

It has been determined that it is rare that two skiers stand on their skis in exactly the same way. The reason for this lies in the fact that skier's feet differ from one another, as do the boots that they wear. Some skiers tend to put more of their weight on the outside edge of their boot, while others concentrate their weight on the inside edges of their boots. Since this concentration of weight is transmitted to the edges of the skis below the boots, it is obvious that a deleterious effect may follow. To compensate for these variations in the way a skier stands on his skis, various devices have been devised, one being a wedge-like member that may be positioned under the boot in such a way that it equalizes the pressure on both edges of the ski when the skier is standing normally. Unfortunately, this creates an unnatural condition that the skier must become accustomed to, or which he cannot become accustomed to, resulting in less enjoyable skiing. With the pair of drag probes mounted on skis as illustrated in FIGS. 1 through 3, it will be apparent that since each of the left and right hand probes can be separately adjusted for penetration depth, the drag on the inside or outside edges of the skis may be adjusted to compensate for the way in which the skier naturally stands on his skis without the addition of other devices attempting to correct his natural stance. This individual "trim" adjustment capability thus removes toe in/out tendencies and reduces muscle fatigue, thus resulting in more enjoyable skiing.

The drag probe embodiment illustrated in FIGS. 1 through 3, is configured to function either as an add-on unit to existing toe pieces, or as a configuration that could be integrated physically and functionally with a toe piece mechanism in one composite unit. There are disclosed hereinafter several embodiments which could be suitably integrated into a toe piece design, with the exact component dimensions being adjusted to optimally integrate the drag probe mechanism with different toe piece mechanisms in an integrated composite unit.

ALTERNATE EMBODIMENTS

Figure 5:
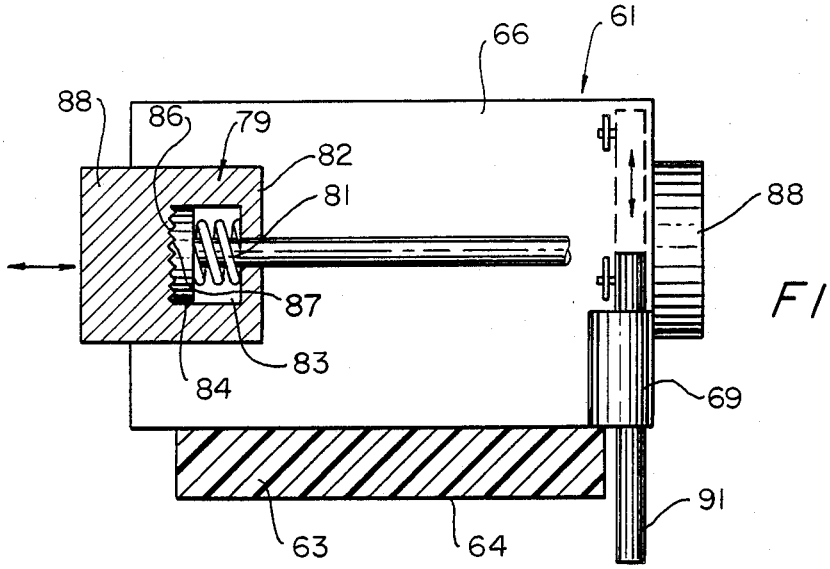
FIG. 5 is a fragmentary vertical cross-sectional view of another embodiment illustrating a cam-operated probe means. The view is taken in the plane indicated by the line 2—2 in FIG. 7.
Figure 6:
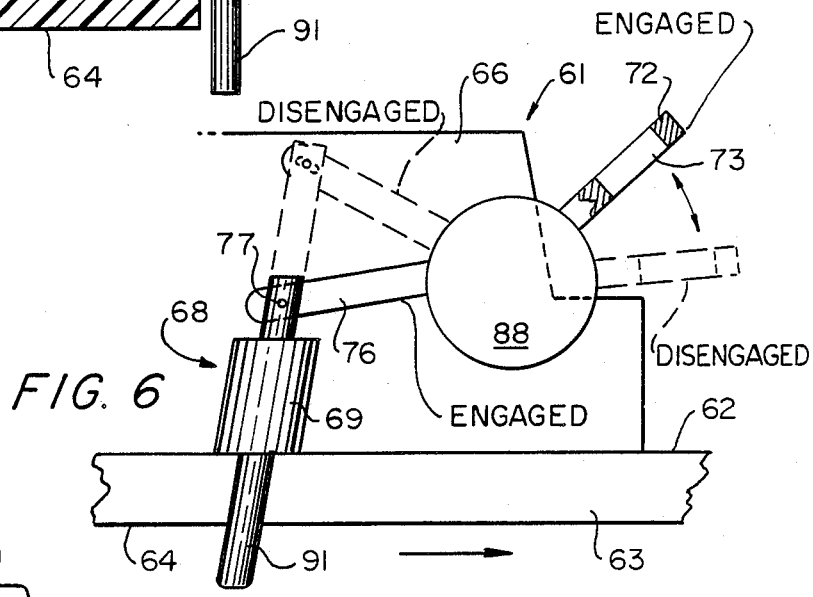
FIG. 6 is a side elevational view of the cam-operated probe means of FIG. 5, showing the cam-actuating levers in full lines in the probe-engaged position, and in broken lines in the probe-retracted position.
Figure 7:
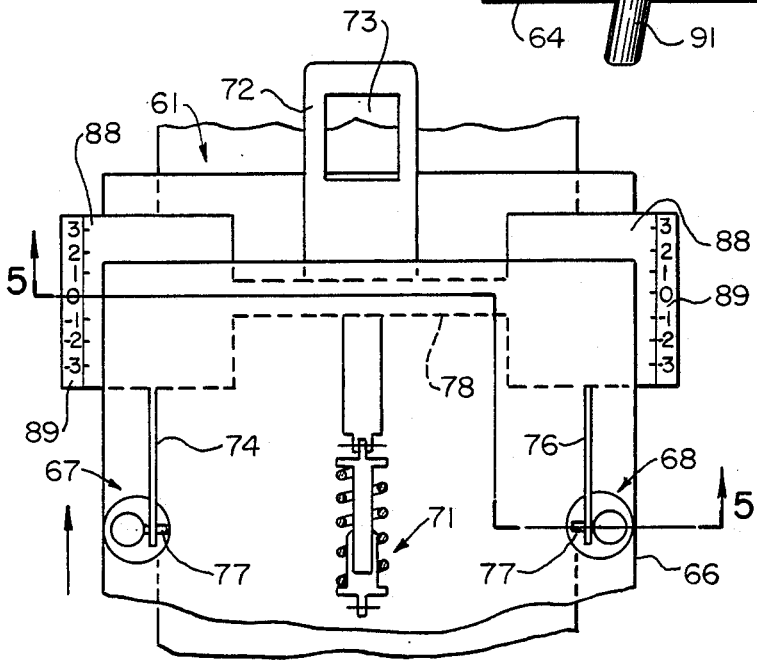
FIG. 7 is a top plan view of the embodiment illustrated in FIGS. 5 and 6, illustrating a vernier control for controlling the depth of penetration of the probes.

Referring to FIGS. 5 through 7, there is there shown schematically a drag probe mechanism designated generally by the numeral 61 and mounted on the top surface 62 of a ski 63 having a lower running surface 64 adapted to run on the snow. The drag probe assembly 61 includes a body portion 66 on opposite sides of which are mounted probe assemblies 67 and 68 each probe 67 and 68 including a slide bearing 69 through which the probes are adapted to slide, with slidable movement of each of the probes being imparted by a toggle mechanism designated generally by the numeral 71 upon actuation of an actuation lever 72 by insertion of the end of the ski pole into the recess 73 of the actuation lever.

The toggle mechanism 71 and actuating lever 72 work in conjunction with levers 74 and 76 suitably pivoted to the associated drag probes by appropriate pins 77 as illustrated, the associated ends of the levers 74 and 76 being slotted to accommodate axial displacement of the pivot pins 77 in relation to the associated levers when the levers are pivoted from one position to another. The levers 74 and 76 are adjustably connected to a common shaft 78, each end of which carries a vernier assembly designated generally by the numeral 79, and to which the associated levers 74 and 76 are pivotally connected.

Vernier assembly 79 includes a coil compression spring 81 captured in the housing 82 having a recess 83 within which there is disposed for axial displacement therein a toothed ring 84 mounted fixedly on the shaft 78 and having teeth 86 adapted to mesh with complementary teeth 87 formed in the housing recess. Thus, individual adjustment of each of the probes is accomplished by pulling outwardly on the vernier knob 88 to disengage the teeth 86 and 87 and then rotating the knob in whatever direction is appropriate in accordance with the indicia 89 marked on the periphery thereof. The knob is then released and the teeth 86 and 87 are permitted to reengage, whereupon rotation of the shaft 78 by the actuation handle 72 will effect simultaneous axial translation of the probe 68 to either engage or disengage that portion 91 of the probe projecting below the lower surface 64 of the ski and engaging the snow to whatever depth is individually determined to be optimal by adjustment of the vernier knob 88. It will be seen that in this embodiment of the invention, the drag probe portion 91 that extends below the lower surface 64 of the ski is canted rearwardly for the same reasons explained in connection with the embodiment of the invention illustrated in FIGS. 1 through 3.

Figure 8:
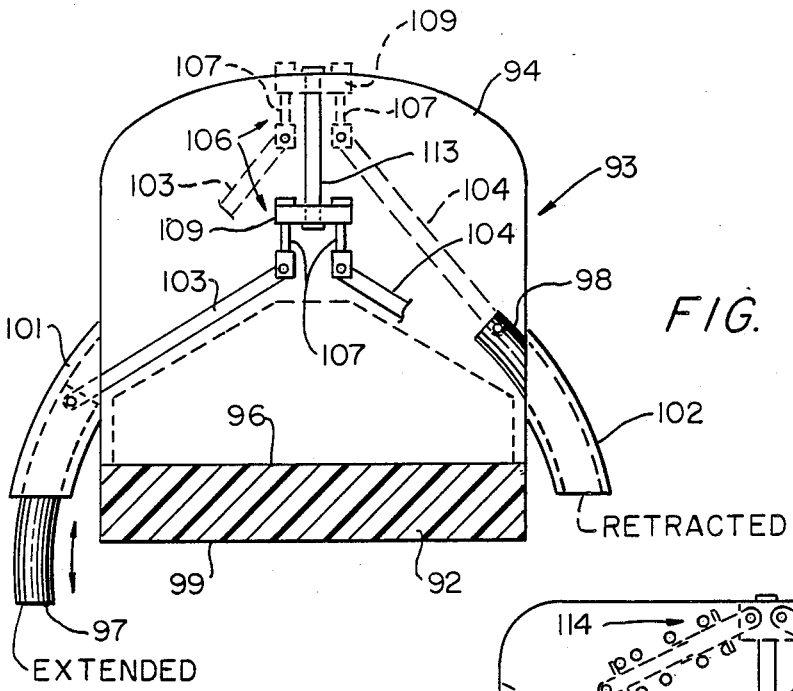
FIG. 8 is a vertical cross-sectional view of another embodiment of the invention incorporating a toggle mechanism for actuation of the drag probes. Both probes extend and retract together, but for illustration, the right probe is shown retracted and the left probe extended. The view is taken in the plane indicated by the line 8—8 in FIG. 10.
Figure 9:
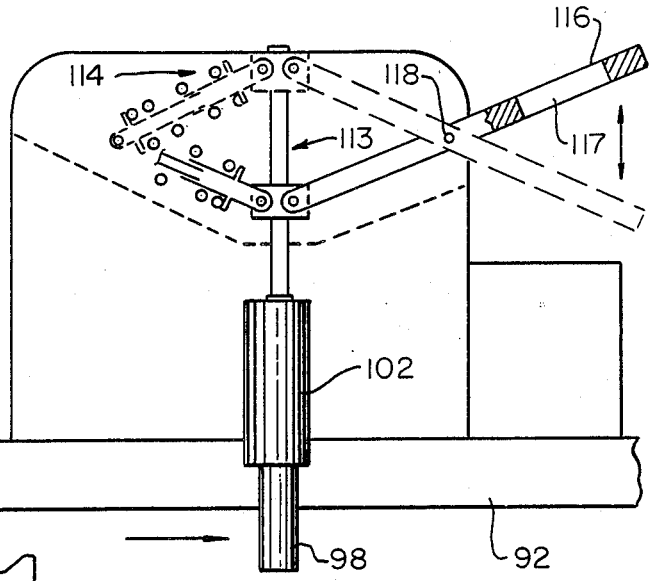
FIG. 9 is a side elevational view of the toggle arrangement illustrated in FIG. 8 taken in the direction of the arrows 9—9 in FIG. 10.
Figure 10:
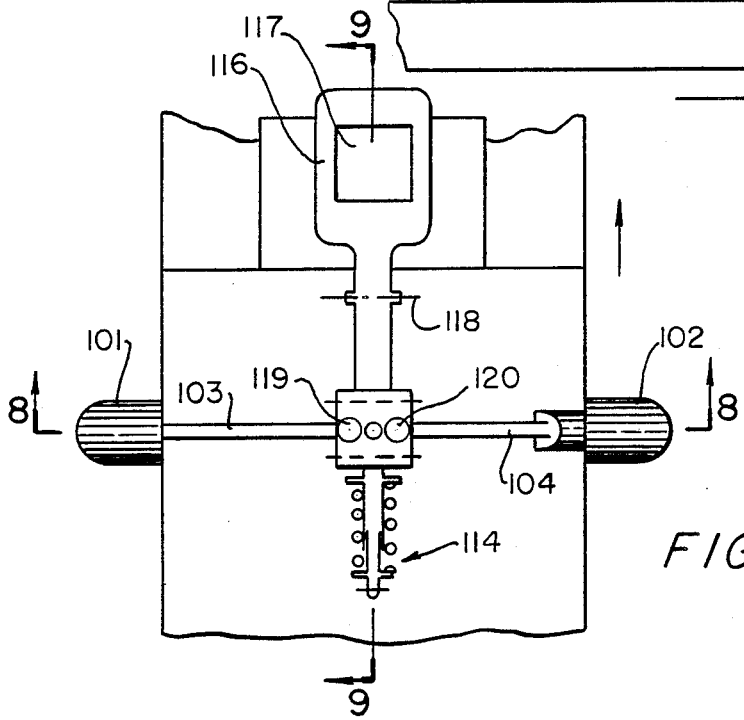
FIG. 10 is a top plan view of the toggle mechanism of FIGS. 8 and 9, illustrating the ski pole socket that is utilized to adjust the probe from a fully extended to a retracted position.

In the embodiment of the invention illustrated in FIGS. 8 through 10, each ski 92 is equipped with a drag probe mechanism designated generally by the numeral 93, and each drag probe mechanism comprises a base member 94 adapted to be bolted or otherwise secured to the top surface 96 of the ski, and to support in actuating position thereon, a left probe 97 and a right probe 98 as viewed in FIG. 8. Both probes 97 and 98 are adapted to be actuated simultaneously in such manner as to either extend below the lower surface 99 of the ski 92 (full lines), or to be elevated to a position as illustrated in broken lines on the right of FIG. 8 in which the probe is shown retracted out of contact with the snow on which the ski is adapted to run.

To lend lateral stability to each of the probes 97 and 98, there is provided for each a bearing tube 101 and 102, respectively, the bearing tubes 101 and 102 being curved as illustrated, as are the associated probes. The probes 97 and 98 are connected by links 103 and 104 with a slide assembly designated generally by the numeral 106 and including for each of the links 103 and 104 a slide-bearing subassembly 107. Mounted on the slide bearing 107 is a cross-member 109 connected axially by a shaft 113 adapted to be selectively slid forwardly or backwardly by the toggle mechanism designated generally by the numeral 114 and illustrated in FIGS. 9 and 10. The toggle mechanism 114 is actuated by an actuation lever 116 having an aperture 117 therein adapted to be engaged by the lower end of the ski pole. The actuating handle 116 is pivoted by a pivot pin 118 so that when the actuating handle 116 is displaced vertically as illustrated in FIG. 9, the toggle mechanism 114 functions to switch the probes 97 and 98 from either a fully extended position or a fully retracted position to the opposite condition. Individualized adjustment of the two probes 97 and 98 is effected by individual adjustment of the screws 119 and 120 as shown in FIG. 10.

Figure 11:
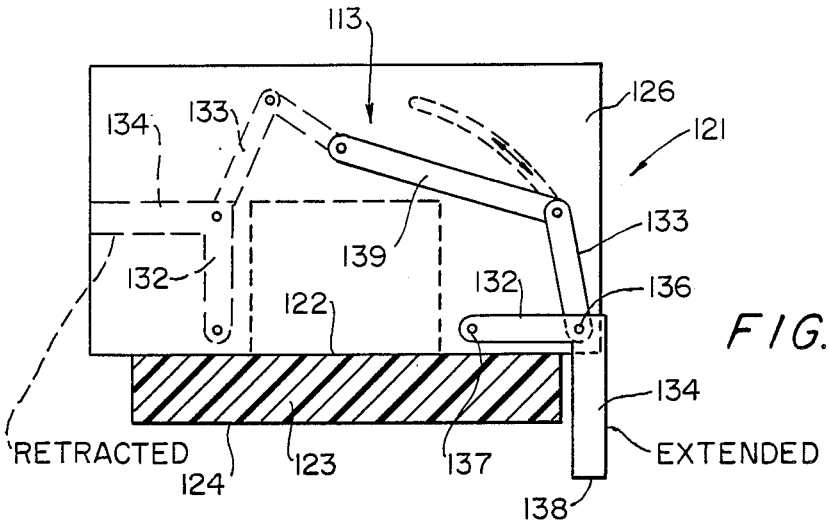
FIG. 11 is a vertical cross-sectional view illustrating a pivoted drag probe structure as distinguished from a slidable probe, and illustrating the linkage arrangement for effecting its deployment and retraction. For illustration, the right probe is shown extended and the left probe retracted. The view is taken in the plane indicated by the line 11—11 in FIG. 13.
Figure 12:
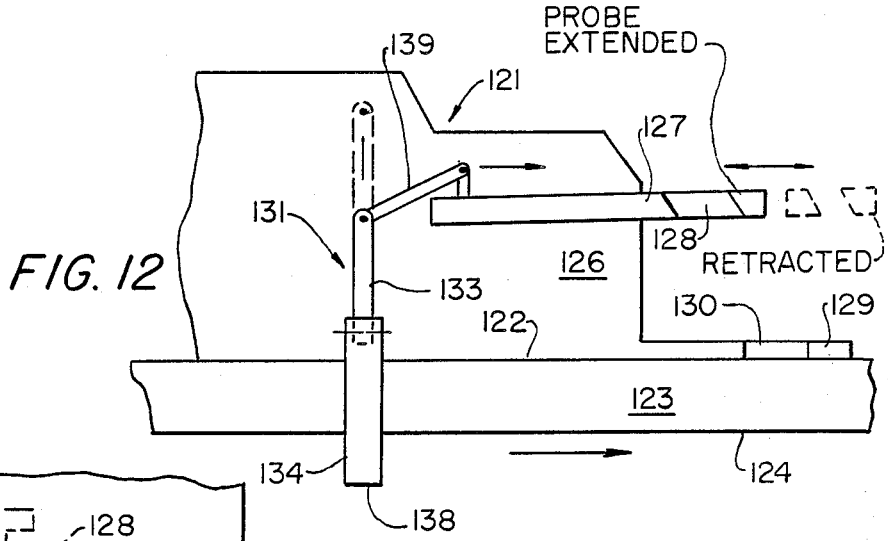
FIG. 12 is a side elevational view of the linkage arrangement illustrated in FIG. 11.
Figure 13:
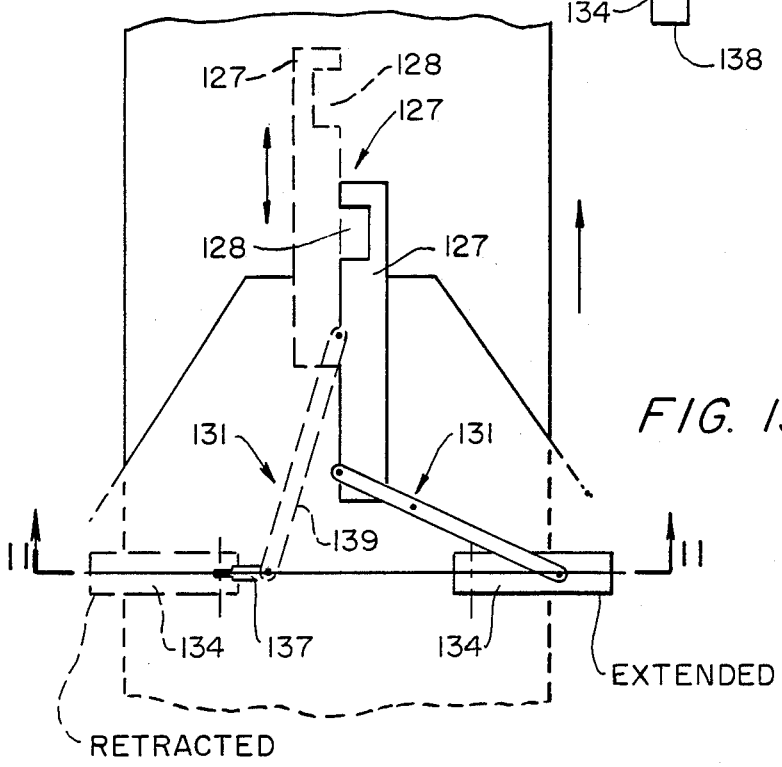
FIG. 13 is a top plan view of the embodiment illustrated in FIGS. 11 and 12. As in FIG. 11, both extended and retracted probe positions are shown.

Referring to FIGS. 11 through 13, there is there shown a laterally rotating probe structure designated generally by the numeral 121, the probe assembly being suitably mounted on the top surface 122 of a snow ski 123 having a lower surface 124 adapted to run on the snow. The laterally rotating probe assembly 121 is suitably mounted on a base member 126 secured to the upper surface 122 of the ski by any suitable means, and provides a slide bearing for a ski-pole-actuated slider member 127 having an aperture 128 therein through which the ski pole may be inserted to effect sliding movement of the slider member 127 in the direction of the arrows. To facilitate such action, the forwardly projecting lip 129 on the body member 126 is provided with a groove 130 into which the end of the ski pole may be inserted and which functions as an abutment against which the end of the ski pole may react when the top end of the ski pole in the hand of the skier is moved forward or backward to impose a sliding force on the slider 127.

At its end remote from the actuation aperture 128, the slider is provided with linkage designated generally by the numeral 131 and including linkage members 132 and 133, both of which are attached to the upper end of associated drag probe 134. Thus, referring to FIGS. 11 and 12, when the slider 127 is translated forwardly, as indicated in FIG. 12, the link 133 imposes a vertically directed component of force on the drag probe 134, pivoting about the pin 136, and the link 132 also pivots about pivot pin 137. This motion causes the drag probe 134 to be elevated until its lower end 138 clears the bottom surface 124 of the ski, at which point it no longer functions to provide drag. It will of course be understood that the link 133 is further connected by a link 139 to the slider 127 so that the linkage 131 responds to sliding movement of the slider 127 in either direction. The alternate positions of the slider 127 are illustrated in FIG. 13.

I have stated above that while the two-probe system or structure is preferable for the many reasons cited, it is possible to utilize a single probe design to provide some of the advantages of the two-probe structures illustrated and described above. One of the advantages of a single probe design is that it offers compact packaging and design simplicity, both of which contribute to lower retail cost to the consumer. Referring to FIGS. 14 and 15, it will there be seen that the ski 140 having a top surface 141 is provided with a base plate 142 configured as explained with respect to FIGS. 1 through 3, to receive the toe piece (not shown), and in relation to which the single probe assembly 146 is mounted. Referring to FIG. 14, it will be noted that the single probe assembly 146 may include a housing 147 having a top wall 148 having an aperture 149 therethrough normally closed by a spring-loaded closure plate 151. The aperture 149 provides access for the lower end of the ski pole 152 which when pressed against the spring-pressed closure plate 151, shifts it into open position as illustrated, permitting the lower end of the ski pole 152 to pass downwardly through the housing 147 to engage the latching-type drag probe sub-assembly 153 as will hereinafter be explained.

The drag probe sub-assembly 153, as illustrated in FIG. 14, comprises a cylindrical insert 154, fabricated from any suitable material such as metal or plastic, and preferably associated as part of the toe piece, and providing a tapered opening 156 in the top end thereof, with the bottom end portion 157 of the insert being securely fastened in an appropriate aperture 158 formed in the ski. The insert 154 is provided with a shoulder 159 adjacent its upper end, just below the tapered opening 156, and at its lower end is provided with a seat 160 to receive a coiled compression spring 161 adapted to underlie an annular nut 162 through the center of which is threaded the drag probe 163. As illustrated, with the drag probe 163 extended so as to drag in the snow, the coil compression spring 161 is compressed and normally biases the nut 162 and the probe 163 upwardly into the position illustrated in broken lines. However, movement of the nut 162 in this direction is impeded by a spring latch 164 arranged to pivot counterclockwise to release the nut 162 so as to permit the coil compression spring 161 to effect axial translation of the drag probe 163 into a retracted position. Tripping of the latch 164 may be effected by depressing the outer end 166 of a latch lever 167 by placing the bottom end of the ski pole 152 against the latch lever extension 166 and pressing downwardly thereon. As will be seen from FIG. 14, this causes the latch 164 to pivot counterclockwise, releasing the nut 162 so as to enable axial translation upwardly of the drag probe 163 into its retracted position.

To reverse the procedure, and to extend the drag probe 163, all that is required is that the ski pole 152 be inserted into the aperture 149, pushing aside the closure plate 151, and pressing downwardly on the nut 162. It will be noted that as the nut 162 moves downwardly, the peripheral edge of the nut engages the latch 164, performing a camming action thereon, causing it to retract against the resilient bias tending to keep it latched, until the top surface of the nut 162 passes below the latch, at which time the latch will be be biased into a latching condition as illustrated in full lines and the probe will then be retained in an extended position. The ski pole may now be withdrawn and used for its conventional purpose. If it happens that the skier wishes to modify the extent of projection of the drag probe 163 below the lower surface of the ski, all that is required is that he insert a screwdriver through the aperture 149 and engage the screw slot 168 formed in the top of the probe 163, rotating the probe either clockwise or counterclockwise in relation to the nut 162, which is held stationary, to modify the extent of projection of the drag probe 163 in relation to the bottom surface of the ski.

Comparing the various embodiments described and illustrated herein, it will be realized that the single probe configuration illustrated in FIGS. 14 and 15 is the only drag probe assembly that penetrates the ski. All of the other embodiments, as will be obvious from a review of the drawings, embrace the associated ski and thus provide pairs of drag probes, the drag probes of each pair being on opposite sides of the centerline of the ski and being spaced outwardly from the associated edges of the ski a predetermined amount. It will of course be understood that even the embodiments which are herein illustrated as embracing the outer edges of the ski, could by obvious re-design, be implemented so as to cause the drag probes to penetrate the skis in much the same way that the drag probe 163 of FIG. 14 penetrates the ski 140. The obvious advantage to such a "penetration" configuration is that it enables more compact packaging of the drag probe mechanism in relation to the ski. The disadvantages, however, are believed to outweigh the advantages, and it is therefore preferred that the double probe system be employed so as to embrace the ski, with no penetration of the ski by the probe. One of the disadvantages of redesigning the double probe system as illustrated in FIGS. 1 through 13 so that the drag probes penetrate the ski is that pairs of holes would have to be bored through the ski, creating a weakness in the ski which would of course require reinforcement. Additionally, the pairs of drag probes would have to be placed closer to the centerline of the ski, bringing the drag probes closer together, and this would effect a reduction in the turning moment generated in the ski as compared to probes spaced from the lateral edges of the ski.

An effort has been made to illustrate and describe a drag probe system for snow skis, the drag probes being associated near the center of gravity of the skier in a normal downhill skiing attitude. In summary, I have attempted to illustrate schematically and to describe and teach the fact that snow is in fact a fluid medium much like air or water. Accordingly, adding drag probes as illustrated and described herein adds fluid dynamic control surfaces to downhill skiing in much the same way that ailerons function on an airplane. In all instances, the structures illustrated schematically and described are designed to utilize the natural body movements of the skier to regulate the dynamic forces working on the control surfaces provided by the drag probes. It is believed that these are new and novel approaches to ski control. It is for this reason that I have illustrated schematically and described various structures which may be implemented to effectuate this new and novel method of ski control through use of auxiliary control surfaces such as drag probes interacting with the body of snow over which the skis traverse.

Having thus described the invention, what is believed to be new and novel and sought to be protected by letters patent of the United States is as follows.

I claim:

1. A ski control assembly for use with a downhill snow ski having an elongated body defined by an upper skier support surface, a lower snow engaging running surface and spaced lateral side edge surfaces, and having a ski boot attachment toe piece fixed on said upper skier support surface, said ski control assembly comprising:

a pair of control surfaces mounted on said downhill ski in the region of the center of pressure of said downhill ski and generally adjacent said toe piece, each of said control surfaces including a cylindrical drag probe disposed adjacent one of said lateral side edge surfaces of said downhill ski, said drag probes of said pair of control surfaces being disposed adjacent opposite ones of said lateral side edge surfaces of said downhill ski;

means for selectively deploying said pair of control surfaces to cause said drag probes to penetrate the snow to enable a downhill skier, through the execution of conventional body movements, to impart auxiliary control forces on said downhill ski as it moves in relation to the snow to provide enhanced control over drag and enhanced maneuverability; and means for adjustably mounting each of said drag probes of said pair of control surfaces on said ski to penetrate the snow to different depths whereby differential drag forces may be imposed on said downhill ski adjacent opposite ones of said lateral side edge surfaces.

2. The ski control assembly of claim 1 further including:

a base fixed to said upper skier-support surface of the ski; and means mounted on said base for supporting said control surfaces for selective displacement by said skier to deploy said control surfaces into engagement with the snow and to retract said control surfaces from the snow.

3. The ski control assembly of claim 2 further including a yoke pivotally mounted on said base for supporting said control surfaces, and means for manipulation by a skier to adjust the position of said control surfaces in relation to said running surface of the ski.

4. The ski control assembly of claim 3 in which means are provided operatively disposed between said yoke and said elongated ski body to resiliently retain said yoke and said control surfaces in said adjusted position.

5. In combination with a snow ski having an elongated body defined by an upper skier-support surface and a lower snow-engaging running surface defined by lateral side edge surfaces and having ski boot attachment means fixed on the upper skier-support surface, auxiliary ski control assembly means mounted on said ski and including a pair of control surfaces mounted on said ski near the center of pressure of the ski which is also near the vertical projection of the skier's center of gravity on said ski for most skiing maneuvers and selectively deployable to penetrate the snow to thereby enable the skier through execution of conventional body movements to impart auxiliary control forces on said ski when it moves in relation to the snow to provide enhanced control over drag and enhanced maneuverability; the control surfaces of said pair thereof operatively associated with opposite lateral side edge surfaces of the ski, said control surfaces comprising drag probes adjustably mounted on said ski to penetrate the snow to different depths whereby differential drag forces may be imposed on said ski adjacent opposite lateral side edge surfaces thereof; said control surfaces comprising a pair of cylindrical drag probes disposed to selectively penetrate the body of snow.

6. In combination with a snow ski having an elongated body defined by an upper skier-support surface and a lower snow-engaging running surface defined by lateral side edge surfaces and having ski boot attachment means fixed on the upper skier-support surface, auxiliary ski control assembly means mounted on said ski and including a pair of control surface mounted on said ski and selectively deployable to penetrate the snow to thereby enable the skier through execution of conventional body movements to impart auxiliary control forces on said ski when it moves in relation to the snow to provide enhanced control over drag and enhanced maneuverability; the control surfaces of said pair thereof operatively associated with opposite lateral side edge surfaces of the ski and comprising drag probes adjustably mounted on said ski to penetrate the snow to differrent depths whereby differential drag forces may be imposed on said ski adjacent opposite lateral side edge surfaces thereof; said control surfaces comprising a pair of cylindrical drag probes disposed to selectively penetrate the body of snow to different depths; a yoke pivotally mounted on said base for supporting said control surfaces; and means on said yoke adapted for manipulation by said skier to adjust the position of said control surfaces in relation to the running surface of the ski; said drag probes being threadably mounted on said support means whereby each probe may be individually adapted to project more or less into said snow in relation to the running surface of the ski.

7. A method for controlling the action of downhill snow skis on a body of snow with which said downhill skis are in contact during a downhill run for providing enhanced maneuverability, said method comprising the steps of:

providing spaced control surfaces on each of said downhill skis near the center of pressure of each said downhill ski, generally adjacent a toe piece which is fixedly secured to each said downhill snow ski, and apart from lateral side edge surfaces which define running surfaces of each of said skis;

operatively deploying said spaced control surfaces into penetrating engagement with the snow below the level of said running surfaces from a non-deployed position of non-contact with the snow;

interacting said spaced control surfaces with the body of snow during a downhill ski run for providing drag to said skis;

transmitting body movements of a skier directly through said toe pieces to said downhill skis and to said control surfaces during said downhill ski run;

selectively shifting the weight of a skier laterally with respect to a longitudinal axis of each of said skis to rotate each of said skis about said longitudinal axis for increasing said penetrating engagement of a selected one of said spaced control surfaces on each of said downhill skis with the snow; and providing a rotational moment of each said downhill ski about said selected one of said spaced control surfaces through said lateral weight shifting for enhancing maneuverability of said skis.

8. The method of claim 7 further including setting a depth of penetration of said spaced control surfaces into the snow prior to the commencement of a downhill run by a skier.

9. The method of claim 7 further including adjusting a depth of penetration of said spaced control surfaces into the snow during a downhill run by a skier.

10. The method of claim 7, further including applying said rotational moment of the downhill skis in opposite directions about said centers of pressure of said skis by a skier by moving his knees toward each other whereby corresponding control surfaces associated with adjacent juxtaposed side edges of the skis are caused to penetrate the snow to a greater depth than control surfaces associated with corresponding remote side edges of the skis.

11. The method of claim 7, further including effecting parallel turning of the skis by leaning a skier's body in the direction of the turn whereby control surfaces corresponding to the direction of turn are caused to penetrate the snow to a greater depth than opposite control surfaces.

12. The method of controlling the action of the running surfaces of snow skies on a body of snow with which they are in contact in a downhill run for the purpose of providing enhanced control over axial drag and lateral maneuverability, comprising the steps of:

(a) deploying into operative engagment with the snow selected control surfaces mounted on the skis apart from said running surfaces;

(b) controlling the interaction of said control surfaces with the body of snow to provide enhanced control over drag and enhanced maneuverability through execution of conventional body movements by the skier; and (c) effecting a body movement by the skier to shift the center of gravity forward in relation to the skis resulting in stabilizing the direction of movement of the skis to a straight path over the snow.

13. The method of controlling the action of the running surfaces of snow skis on a body of snow with which they are in contact in a downhill run for the purpose of providing enhanced control over axial drag and lateral maneuverability, comprising the steps of:

(a) deploying into operative engagement with the snow selected control surfaces mounted on the skis apart from said running surfaces;

(b) controlling the interaction of said control surfaces with the body of snow to provide enhanced control over drag and enhanced maneuverability through execution of conventional body movements by the skier; and (c) effecting a body movement by the skier to shift the center of gravity rearwardly in relation to the skis results in de-stabilizing the skis ahead of the center of gravity whereby parallel turns are more easily effected.

* * * * *